US005308724A

United States Patent [19]

Takanashi et al.

[11] Patent Number: 5,308,724

[45] Date of Patent: May 3, 1994

[54] PHOTOSENSITIVE MEDIUM FOR RECORDING CHARGE LATENT IMAGE AND RECORDING METHOD THEREOF

[75] Inventors: Itsuo Takanashi, Kamakura; Shintaro Nakagaki, Fujisawa; Hirohiko Shinonaga; Tsutou Asakura, both of Yokohama; Masato Furuya; Tetsuji Suzuki, both of Yokosuka, all of Japan

[73] Assignee: Victor Company of Japan, Ltd., Yokohama, Japan

[21] Appl. No.: 869,884

[22] Filed: Apr. 14, 1992

Related U.S. Application Data

[62] Division of Ser. No. 496,680, Mar. 21, 1990.

[30] Foreign Application Priority Data

Mar. 24, 1989 [JP] Japan ..... 1-72637
Mar. 31, 1989 [JP] Japan ..... 1-83755

[51] Int. Cl.[5] ..... G03G 13/04

[52] U.S. Cl. ..... 430/48; 430/55; 365/106; 365/112

[58] Field of Search ..... 430/48, 55, 56, 346; 365/108, 112, 106

[56] References Cited

U.S. PATENT DOCUMENTS 4,282,297 8/1981 Fotland ..... 430/48
4,296,478 10/1981 Kiess et al. .
4,675,265 6/1987 Kazama et al. ..... 430/66
4,786,971 11/1988 Kaneko et al. .
4,859,553 8/1989 Jansen et al. ..... 430/63

FOREIGN PATENT DOCUMENTS 0342967 12/1990 European Pat. Off. .
1512670 5/1989 United Kingdom .

*Primary Examiner*—Steve Rosasco
*Attorney, Agent, or Firm*—Michael N. Meller

[57] ABSTRACT

There is provided a photosensitive medium for recording a charge latent image, composed of a photo-conductive layer having an electrode and a protective layer at each surface thereof. There is further provided a charge latent image recording method. A photo-conductive layer and a charge holding layer, each having an electrode at a surface thereof, are arranged to face each other through a gap. A predetermined voltage is applied across the photo-conductive layer and the charge holding layer through the electrodes to cause discharge thereacross. At the time, an electro-magnetic wave corresponding to the charge latent image intended to be recorded is emitted to the photo-conductive layer. The impedance of the photo-conductive layer is thus varied to record the charge latent image on the charge holding layer. In the method, the rise time constant of the voltage applied across the electrodes is adjusted to that of the discharge or more, and the potential of the charge latent image is adjusted to a discharge starting voltage or less.

2 Claims, 5 Drawing Sheets

PHOTOSENSITIVE MEDIUM FOR RECORDING CHARGE LATENT IMAGE AND RECORDING METHOD THEREOF

This application is a division of application Ser. No. 496,680, filed Mar. 21, 1990.

BACKGROUND OF THE INVENTION

This invention relates to a photosensitive medium for recording a charge latent image and a recording method thereof.

In compliance with an increased demand for a reproduced image with high picture quality and high resolution in recent years, as well known, various systems such as so-called EDTV (Extended Definition TV) system, or HDTV (High Definition TV) system have been proposed for a television system. In order to obtain a reproduced image with high picture quality and high resolution, it is required to provide an image pickup device capable of producing a video signal from which a high picture quality and high resolution image can be recreated. However, for conventional image pickup devices using an image pickup tube, it is difficult to generate such a video signal. The reasons for this are as follows: Since there is a limit to the reduction of the diameter of an electron beam in the pickup tube, high resolution image reproduction by reduction of the diameter of the electron beam cannot be expected. Alternatively, if the target area of the pickup tube is increased, the level of the output signal will be reduced because of the increased output capacity which is proportional to the area of the target. Therefore, high resolution image reproduction by the increase of the target area cannot be realistic. Furthermore, in the case of an image pickup device for a moving picture, since the frequency range of such a video signal reaches several tens to several hundreds MHz for implementation of the high resolution image, the increase of output capacity, i.e. the increase of target area is not preferable.

On the other hand, an increase of pixels or downsizing a pixel of solid state image sensors has difficulties known to the industry.

As stated above, conventional image pickup devices of either a pickup tube or a solid state sensor could not satisfactorily generate such a video signal to provide a reproduced image of high picture quality and high resolution because of the inevitable use of an image sensor for the construction thereof. In order to solve this, the assignee of this application has already proposed an imaging system and a recording system to obtain a high resolution optical image by an image pickup device using a photo-to-photo transducer, and to record such an optical image as a charge image of high resolution onto a charge accumulation layer (or a charge holding layer) by using a photo-to-charge transducer.

The recording system using a photo-to-charge transducer will be explained with reference to FIG. 1.

Throughout the drawings, like reference numerals and letters are used to designate like or equivalent elements for the sake of simplicity of explanation.

The photosensitive medium 1 for recording a charge latent image shown in FIG. 1 is composed of a glass substrate 2 allowing an electro-magnetic wave to pass therethrough, an electrode 3 also allowing the electro-magnetic wave to pass therethrough and a photo-conductive layer 4 composed of a photo-conductive material, such as α-Se (amorphous Selenium) and PVK (Poly-N-Vinylcarbazole), the impedance of which is varied accordingly with the intensity of the electro-magnetic wave. These members are laminated in order, thus constituting the photosensitive medium 1. The electro-magnetic wave in this specification includes an electro-magnetic radiation beam such as X-rays, γ-rays, radio wave or light.

A recording medium 5 is placed to face the photosensitive medium 1 on the side of the photo-conductive layer 4 thereof through a specific gap. The recording medium 5 is composed of a substrate 8, an electrode 7 and a charge holding layer 6 laminated in order. The charge holding layer 6 thus faces the photo-conductive layer 4 in the configuration.

A d.c. voltage source 9 applies a voltage across the electrodes 3 and 7 through a switch 10.

In the configuration, when the electro-magnetic wave is emitted to the glass substrate 2 to pass therethrough and reach the photo-conductive layer 4 through the electrode 3, the impedance thereof is varied accordingly with the intensity of the electro-magnetic wave. A charge latent image according to the intensity is thus recorded on the charge holding layer 6 of the recording medium 5 by discharge of the electric field generated due to the voltage which is applied across the electrodes 3 and 7.

This configuration has the disadvantage that the photosensitive medium 1 or recording medium 5 may be broken down when the voltage is rapidly applied thereto.

The cause of the breakdown will be explained with reference to FIG. 2 showing the graphs which represent voltages of the parts in the configuration in the case of applying the voltage across the electrodes 3 and 7.

In FIG. 2, the graph A expresses the inter-electrode voltage applied across the electrodes 3 and 7, the graph B the gap voltage across the gap and the graph C the surface potential of the recording medium 5 due to discharged charges, and the point P the voltage across the gap when the inter-electrode voltage is initially applied.

The switch 10 is closed to cause the d.c. voltage source 9 to apply the voltage across the electrodes 3 and 7. The inter-electrode voltage rises momentarily and rapidly at the time, as represented by the graph A. The gap voltage (the graph B) at the time is depicted by the point P which is the voltage of the gap divided by each equivalent capacity of the photo-conductive layer 4, the gap and the charge holding layer 6 and exceeds over the discharge-starting voltage $V_B$.

Discharge then occurs and the surface potential of the medium 5 (the graph C) rises with a certain time constant until the gap voltage becomes lower than the discharge-starting voltage $V_B$.

As is already described, the momentary large voltage to the gap and also the momentary rise of discharge voltage may cause the breakdown of the solid portion of the photo-conductive layer 4 and the charge holding layer 6. Irregularity or pin holes on the solid portion which lead the electric field to converge thereon also may cause breakdown.

Next, a charge latent image recording/reproducing system using photo-to-charge and photo-to-photo transducers will be explained with reference to FIGS. 3 and 4.

In FIG. 3, a d.c. voltage source 11 is connected across the electrode 3 of the photosensitive medium 1 and the electrode 7 of the recording medium 5 to apply a voltage $V_1$ thereacross. The other parts of the configuration and the fundamental charge latent image recording operation are same as those shown in FIG. 1.

While in FIG. 4, a charge latent image reading member 12 is composed of an electrode 13 allowing a reading light to pass therethrough, a photo-modulation layer 14 modulating the reading light accordingly with the intensity of charges and a dielectric mirror layer 15 laminated in order. The reading light is a modulative electro-magnetic wave including an electro-magnetic radiation beam such as X-rays, γ-rays, radio wave or light.

The recording medium 5 which is storing the charge latent image is placed to face the charge latent image reading member 12 on the side of the dielectric mirror layer 15 thereof such that the charge holding layer 6 faces the dielectric mirror layer 15. Furthermore, the electrode 7 of the recording medium 5 and the electrode 13 of the reading member 13 are connected to each other.

In the configuration, when a reading light is emitted to the electrode 13 through a semi-transparent mirror 16 to reach the photo-modulation layer 14 through the electrode 13, the electric field corresponding to the charge latent image distribution which has been recorded on the charge holding layer 6 is applied to the photo-modulation layer 14, which modulates the reading light accordingly with the charge latent image distribution.

The modulated light is reflected in the dielectric mirror 15 and passes the electrode 13. The direction of the modulated light is then changed by the semitransparent mirror 16. The modulated light is thus read out.

There are disadvantages in the configuration that the discharge is generated across the reading member 12 and the recording medium 5 when the charge latent image is read out from the recording medium 5. This causes the charge latent image to be damaged or the reading member 12 to be broken down.

SUMMARY OF THE INVENTION

The objects of the present invention are to prevent a photosensitive medium and a recording medium from being broken down at the solid portions thereof and also to prevent discharge from being generated when a charge latent image is read out from the recording medium.

The present invention is thus to provide a photosensitive medium for recording the charge latent image and recording method thereof, which will be described hereinafter, in order to accomplish the above objects.

There is provided a photosensitive medium for recording a charge latent image, composed of a photoconductive layer having an electrode and a protective layer at each surface thereof.

There is further provided a charge latent image recording method. A photo-conductive layer and a charge holding layer, each having an electrode at a surface thereof, are arranged to face each other through a gap. A predetermined voltage is applied across the photo-conductive layer and the charge holding layer through the electrodes to cause discharge thereacross. At the time, an electro-magnetic wave corresponding to the charge latent image intended to be recorded is emitted to the photo-conductive layer. The impedance of the photo-conductive layer is thus varied to record the charge latent image on the charge holding layer.

In the method, the rise time constant of the voltage applied across the electrodes is adjusted to that of the discharge or more, and the potential of the charge latent image is adjusted to a discharge-starting voltage or less.

DETAILED DESCRIPTION OF THE PREFERRED EMBODIMENTS

The present invention will be explained in detail, with reference to the accompanying drawings.

Figure 5:
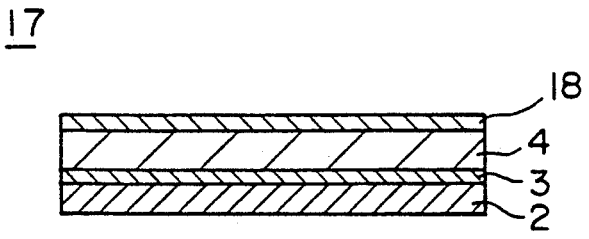
FIG. 5 shows a preferred embodiment of a photosensitive medium for recording a charge latent image according to the present invention.

The photosensitive medium 17 for recording a charge latent image shown in FIG. 5, is composed of a glass substrate 2 allowing an electro-magnetic wave, an electrode 3 also allowing an electro-magnetic wave, a photo-conductive layer 4 composed of a photo-conductive material, such as α-Se or PVK, whose impedance is varied accordingly with the intensity of the electromagnetic wave and a protective layer 18 composed of an insulator such as $SiO_2$, silicon Nitride, PMMA (Polymethylmethacrylate) or resin (silicon, etc.) for preventing a solid portion of such as the photo-conductive layer 4 from being broken down. These members are laminated in order, for constituting the photosensitive medium 17.

Next, a charge latent image recording method using the photosensitive medium 17 will be explained with reference to FIG. 6.

Figure 6:
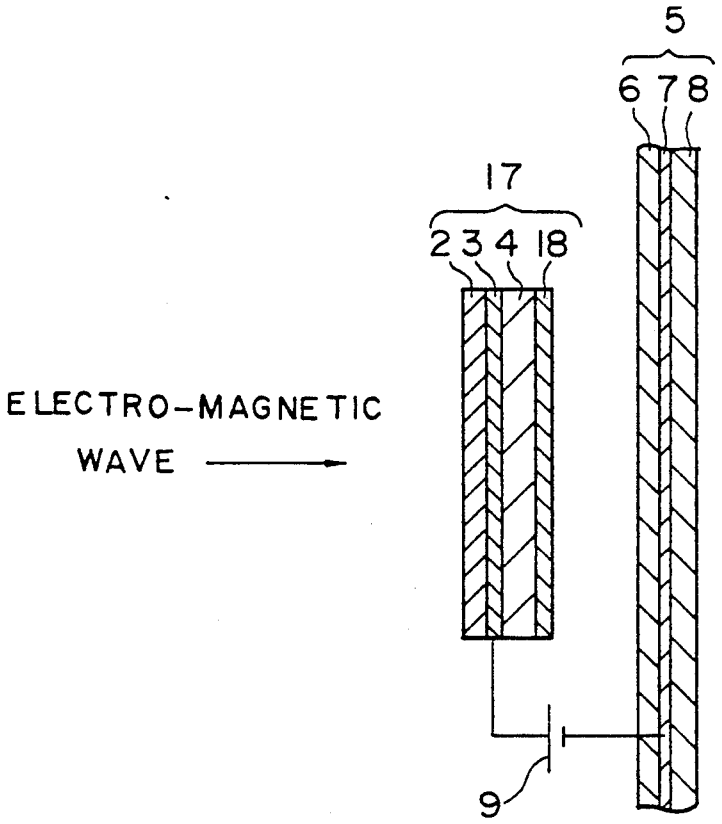
FIG. 6 is a view for explaining a charge latent image recording method using the photosensitive medium shown in FIG. 5.

In FIG. 6, the recording medium 5 is placed to face the photosensitive medium 17 at the side of the protective layer 18 thereof, through a gap having predetermined width. The recording medium 5 is composed of a substrate 8, an electrode 7 and a charge holding layer 6, laminated in order. The charge holding layer 6 faces the protective layer 18 in the configuration. A d.c. voltage source 9 applies a voltage across the electrodes 3 and 7.

The recording operation of the configuration is the same as that explained with reference to FIG. 1. The breakdown-endurability will be lowered if there is a damaged portion such as a pin hole. However, since the photosensitive medium 17 is provided with the protective layer 18, the solid portion of the photosensitive medium 17 is prevented from being broken down or the photo-conductive layer 4 is prevented from being damaged.

Another preferred embodiment of the charge latent image recording method will be explained with reference to FIG. 7.

Figure 1:
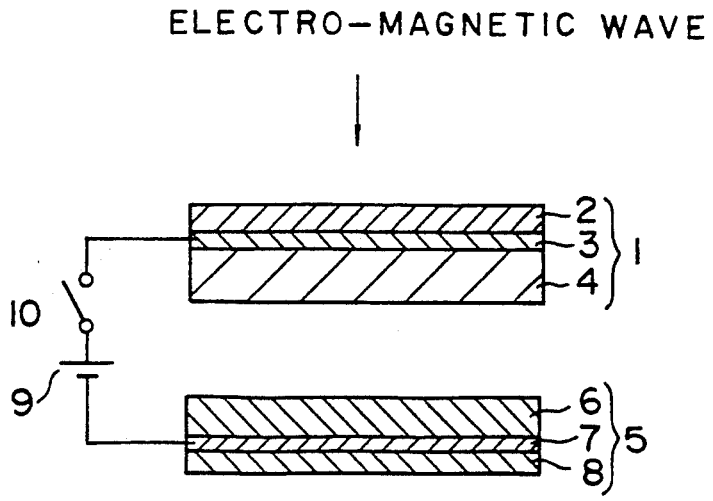
FIG. 1 PRIOR ART
FIG. 1 shows a conventional charge latent image recording method using a photo-to-charge transducer.
Figure 2:
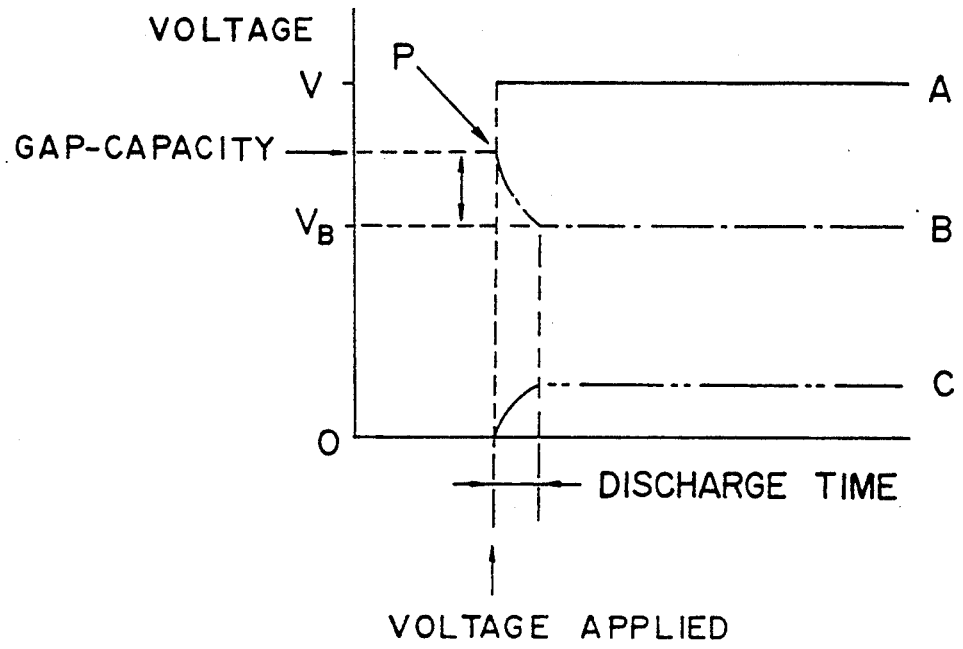
FIG. 2 PRIOR ART
FIG. 2 is graphical representation of the voltages of the parts in the configuration shown in FIG. 1.
Figure 7:
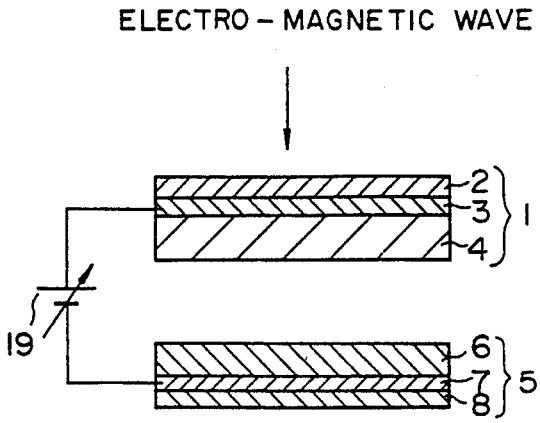
FIG. 7 shows another preferred embodiment of a charge latent image recording method according to the present invention.

In FIG. 7, there is provided a variable d.c. voltage source 19, instead of the d.c. voltage source 9 and the switch 10 shown in FIG. 1. The voltage source 19 gradually increases output voltage thereof to lengthen the rise time of the voltage to longer than that of a surface potential of the recording medium 5 due to discharged charges, or the rise time constant of the voltage longer than that of discharge.

Accordingly, the solid portions of the photosensitive medium 1 and the recording medium 5 are prevented from being broken down and the photo-conductive layer 4 is prevented from being damaged.

Figure 9:
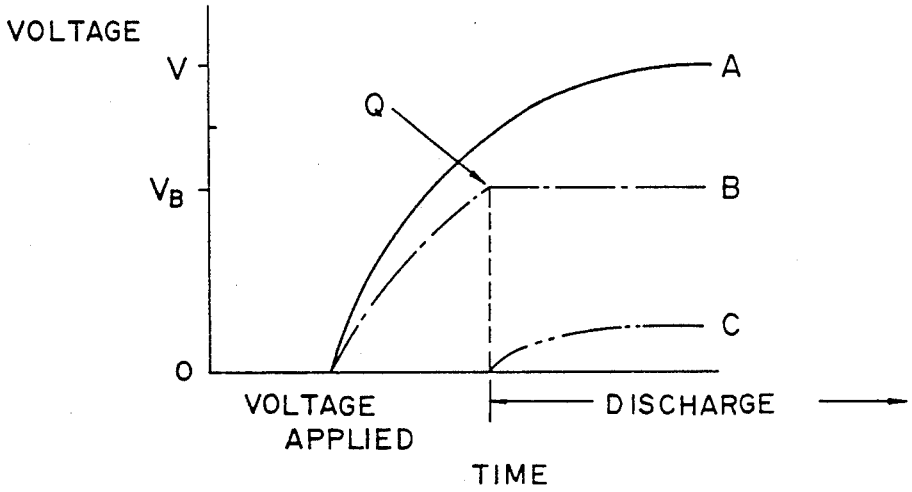
FIG. 9 is graphical representation of voltages of the parts of the preferred embodiment shown in FIG. 7.

FIG. 9 shows the curves of time-varying voltages at the time, with respect to the charge latent image recording method explained with reference to FIG. 7.

The graphs A, B and C represent an inter-electrode voltage applied across the electrodes 3 and 7, a gap voltage across the photosensitive medium 1 and the recording medium 5 and a medium-surface potential due to discharged charges, respectively. The point Q represents the gap voltage which has reached the discharge starting potential $V_B$.

As is understood by FIG. 9, the gradually increased inter-electrode voltage (the graph A) by the voltage source 19 causes the gap voltage (the graph B) to be gradually increased accordingly with the inter-electrode voltage. The gap voltage reaches the discharge starting potential $V_B$ (the point Q) to initiate discharge. The discharge then starts and discharged charges are accumulated on the medium surface in association with the increasing gap voltage. Accumulated charges result in potential rise of the medium surface (the graph c) and cancel increment of the gap voltage, so that the gap voltage is never increased beyond the discharge starting potential $V_B$. The solid portions of the photosensitive medium 1 and the recording medium 5 are therefore prevented from breaking down.

Figure 8:
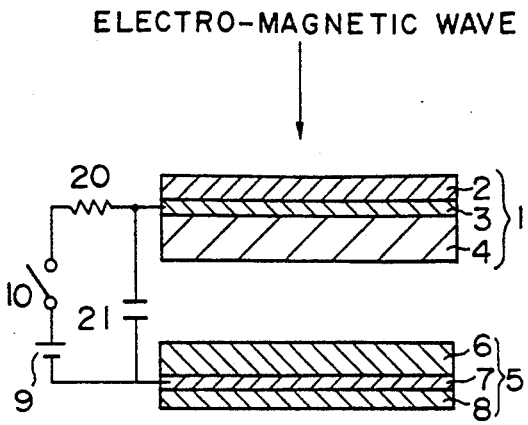
FIG. 8 shows a further preferred embodiment of a charge latent image recording method according to the present invention.

FIG. 8 shows a further preferred embodiment of the charge latent image recording method according to the present invention. In FIG. 8, there is provided a time constant circuit consisting of a resistor 20 and a capacitor 21 combined with the d.c. voltage source 9 and the switch 10, instead of the variable d.c. voltage source 19 in FIG. 7. The time constant properly decided by the resistor 20 and capacitor 21 causes the gap voltage to be gradually increased so as to produce the same effect as that in the embodiment shown in FIG. 7.

The time constant of the inter-electrode voltage larger than that of the discharge consequently causes the solid portions of the photosensitive medium 1 and the recording medium 5 to be prevented from breaking down or the photo-conductive layer 4 from being damaged.

A still further preferred embodiment of the charge latent image recording method according to the present invention will be explained with reference to FIG. 10.

Figure 3:
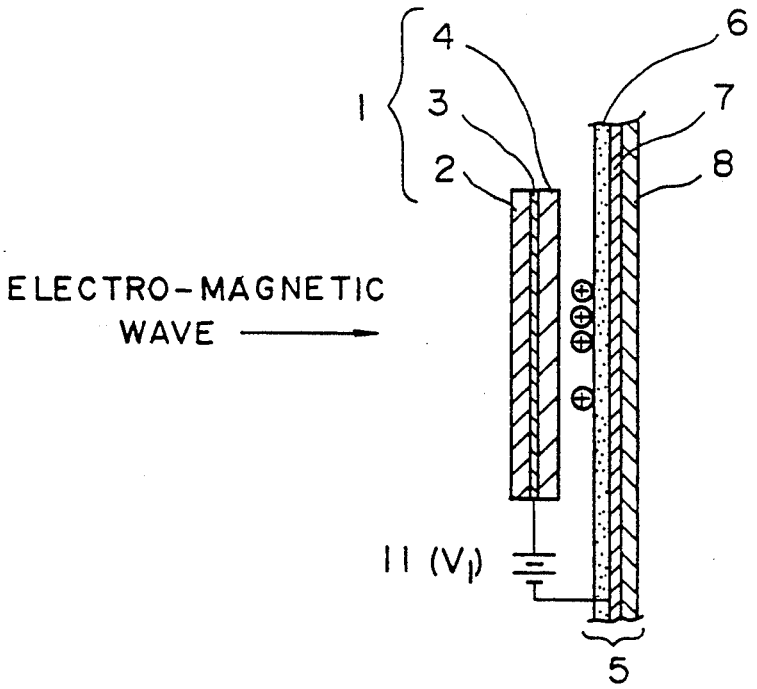
FIG. 3 PRIOR ART
FIG. 3 shows another conventional charge latent image recording method using a photo-to-charge transducer.
Figure 10:
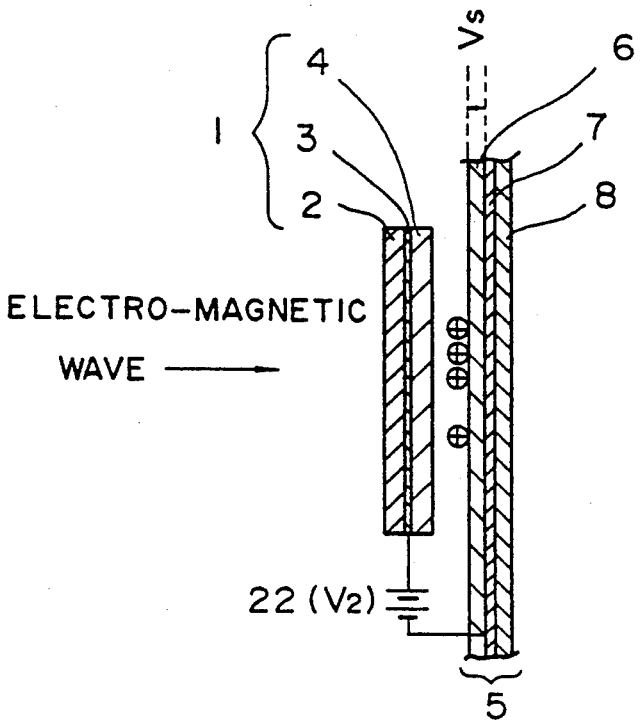
FIG. 10 shows a still further preferred embodiment of a charge latent image recording method according to the present invention.

In FIG. 10, there is provided a d.c. voltage source 22 to apply a voltage $V_2$ across the electrodes 3 and 7, another configuration being the same as those in FIG. 3. An electro-magnetic wave (or optical image) is emitted to the glass substrate 2 and reaches the photo-conductive layer 4 through the glass substrate 2 and the electrode 3. The impedance of the photo-conductive layer 4 is thus varied accordingly with the intensity of the electro-magnetic wave at the time. The electric field distribution across the gap due to the voltage applied across the electrodes 3 and 7 is then varied in accordance with the intensity distribution of the emitted electro-magnetic wave. The charge latent image corresponding to the intensity of the electro-magnetic wave is thus recorded on the charge holding layer 6 of the recording medium 5.

The electric potential $V_s$, from the electrode 7, of the charge latent image to be recorded on the recording medium 5 is established by the length of the gap between the photosensitive medium 1 and the recording medium 5 and the voltage $V_2$ applied across the electrodes 3 and 7. Consequently, if the length of the gap is fixed, the voltage $V_2$ is adjusted to the discharge-starting voltage $V_b$ or more, which is the voltage in the gap established by the gap voltage divided from the voltage $V_2$.

Figure 11:
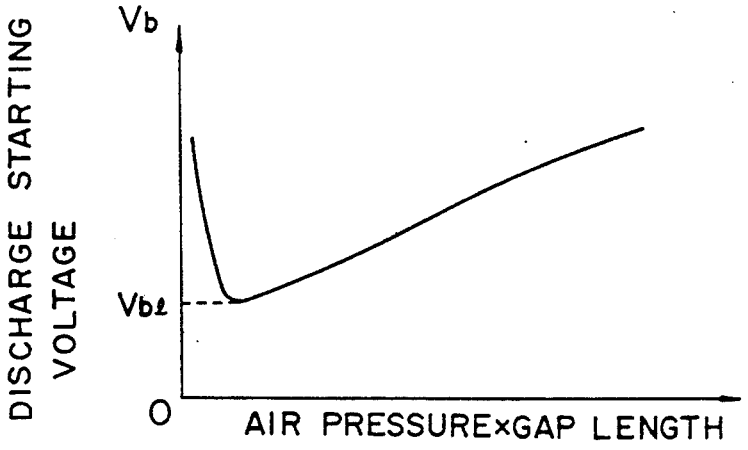
FIG. 11 is graphical representation of a Paschen's curve.

The discharge-starting voltage $V_b$ of the discharge due to application of the voltage across two electrodes facing each other is represented by the graph shown in FIG. 11, the product of the air pressure and the gap length in the abscissa axis and the discharge-starting voltage $V_b$ in the ordinate axis.

The voltage $V_2$ adjusted to the discharge-starting voltage $V_b$ or more, which is the voltage in the gap established by the gap voltage divided from the voltage $V_2$ and the electric potential $V_s$, from the electrode 7, of the charge latent image to be recorded on the recording medium 5, adjusted to the discharge-starting voltage $V_b$ or less prevent the generation of the discharge when the charge latent image which has been recorded is read out. Furthermore, the electric potential $V_s$ adjusted lower than the minimum value $V_{b1}$ shown in FIG. 11 always prevents the generation of the discharge when the charge latent image which has been recorded is read out, without respect to the air pressure or the gap length.

Figure 4:
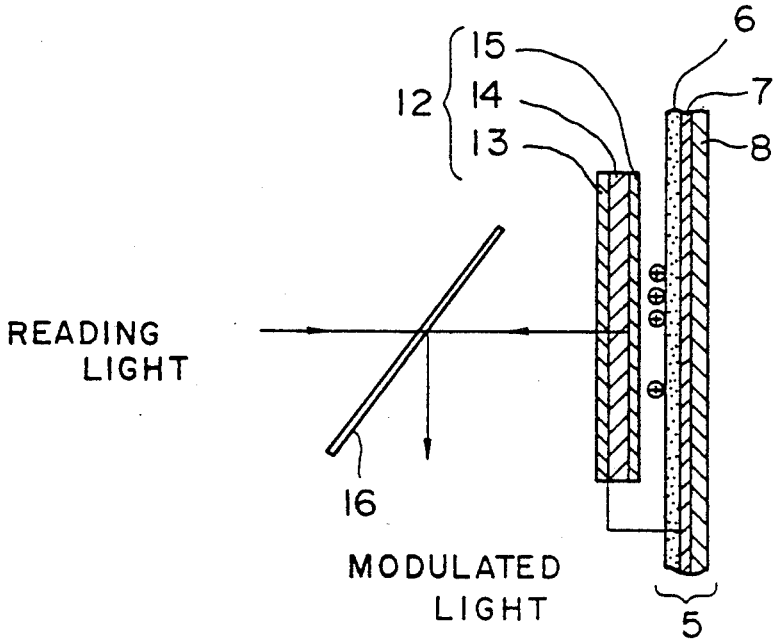
FIG. 4 PRIOR ART
FIG. 4 shows a conventional charge latent image reproducing method using a charge to photo transducer.

Next, the reproducing method for the recorded charge latent image will be explained. The configuration and fundamental reproducing method are same as those explained with reference to FIG. 4. Suppose the charge latent image has been recorded on the recording medium 5, the voltage $V_s$ being lower than the minimum value $V_{b1}$ in FIG. 11. Facing the charge latent image reading member 12 with the recording medium 5 does not cause the gap voltage to exceed the discharge starting voltage. The discharge is thus not generated, since the voltage $V_s$ is lower than the minimum value $V_{b1}$. Accordingly, the reading member 12 is prevented from being destroyed and the charge latent image is prevented from being damaged due to the discharge when the recorded charge latent image is read out.

In this charge latent image reproducing method, the modulated light is reflected in the dielectric mirror 15. It is also available to provide the recording medium 5 with a reflection film, the modulated light being reflected therein or with a transparent substrate for the substrate 8 of the recording medium 5. The modulated light thus passes the transparent substrate then is read out. Furthermore, the reading light may be a spot light or a light beam to scan the recording medium.

What is claimed is:

1. A method for recording a charge latent image on a recording medium, comprising the steps of:

arranging a photo-conductive layer and a charge holding layer to face each other through a gap, each layer having an electrode on a surface thereof and said gap having a predetermined size;

applying a predetermined voltage across said two layers through said two electrodes while substantially maintaining said gap at said predetermined size, the time constant of said predetermined voltage rising to generate a discharge across said two layers, said discharge having a time constant equal to or less than said time constant of said predetermined voltage;

applying an electro-magnetic wave corresponding to a charge latent image intended to be recorded to said photo-conductive layer through said electrode thereof while said discharge is generating to vary impedance of said photo-conductive layer, thus recording said charge latent image on said charge holding layer.

2. A method for recording a charge latent image on a recording medium, comprising the steps of:

arranging a photo-conductive layer and a charge holding layer to face each other through a gap, each layer having an electrode on a surface thereof and said gap having a predetermined size;

applying a predetermined voltage across said two layers through said two electrodes to initiate discharge across said two layers while substantially maintaining said gap at said predetermined size;

applying an electro-magnetic wave, corresponding to a charge latent image intended to be recorded, to said photo-conductive layer through said electrode thereof after said discharge has been initiated to vary the impedance of said photo-conductive layer, thus recording said charge latent image on said charge holding layer, said charge latent image having an electric potential equal to or less than said voltage for initiating said discharge.

* * * * *